United States Patent [19]

Habib et al.

[11] Patent Number: 5,026,213

[45] Date of Patent: Jun. 25, 1991

[54] METHOD AND APPARATUS FOR MAKING A FOUNDATION BY CREATING A BLOCK CONSTITUTED BY THE GROUND ITSELF

[75] Inventors: Pierre Habib, Paris; Andre Martin, Toulon; Minh P. Luong, Vigneux/Seine, all of France

[73] Assignee: Technologie Speciales Ingenierie -T.S.I., Toulon, France

[21] Appl. No.: 381,746

[22] PCT Filed: Nov. 8, 1988

[86] PCT No.: PCT/FR88/00549

§ 371 Date: Jun. 21, 1989

§ 102(e) Date: Jun. 21, 1989

[87] PCT Pub. No.: WO89/04402

PCT Pub. Date: May 18, 1989

[30] Foreign Application Priority Data

Nov. 9, 1987 [FR] France ..... 87 15654

[51] Int. Cl.[5] ..... E02D 27/28

[52] U.S. Cl. ..... 405/229; 52/162; 405/232

[58] Field of Search ..... 405/229, 231, 232, 239, 405/244; 52/155, 162, 163, 164

[56] References Cited

U.S. PATENT DOCUMENTS

| | | | |
|---|---|---|---|
| 3,087,308 | 4/1963 | Hart et al. | 405/244 X |
| 4,043,133 | 8/1977 | Yegge | 405/239 |
| 4,044,513 | 8/1977 | Deike | 52/163 |
| 4,060,994 | 12/1977 | Chitis | 405/244 X |

FOREIGN PATENT DOCUMENTS

| | | |
|---|---|---|
| 161190 | 11/1985 | European Pat. Off. . |
| 1063854 | 5/1954 | France . |
| 1209949 | 3/1960 | France . |
| 2524030 | 9/1983 | France . |
| 2524031 | 9/1983 | France . |
| 2106947 | 4/1983 | United Kingdom . |

*Primary Examiner*—David H. Corbin

[57] ABSTRACT

The present invention provides a method and apparatus for making a foundation by creating a block constituted by the ground itself, the method being characterized in that at least one deep anchor point is established by using anchor means (1) buried underground by pile-driving, which means (3) extend in the anchoring position up to the surface of the ground in order to project beyond the surface; a slab (10) is placed on the surface, the slab including at least one opening for passing extensions from the anchor means; and traction is exerted on the slab in order to presetress the ground by using means situated above the slab (10) to put the anchor means under tension until an in-service force is obtained suitable for holding the structure to be built on the surface.

14 Claims, 4 Drawing Sheets

METHOD AND APPARATUS FOR MAKING A FOUNDATION BY CREATING A BLOCK CONSTITUTED BY THE GROUND ITSELF

The present invention relates to a method and to an apparatus for making a foundation by creating a block constituted by the ground itself.

The technical field of the invention is foundations for structures on the surface such as electricity pylons, antennas, or other similar structures.

At present, such structures are anchored to the ground by means of foundations which are generally constituted by means of blocks made of concrete, reinforced concrete, or prestressed concrete. Another way of making such foundations is to provide anchor points by means of piles or groups of driven piles.

The types of foundation used industrially are based on the following techniques:

Either foundations are made which are massive, e.g. constituted by a block of concrete, in the ground or below ground surface. When the block is not buried below ground surface, then the traction force applied to such a block must be less than the weight of the foundation if it is to remain effective.

If the block is buried underground, then the traction force must remain less than the sum of the following: the weight of the block itself, the weight of the earth above the block, the resultant of lateral friction forces on the block, and suction on the block. With a buried block, it is observed that a major drawback, namely breaking of the concrete block itself may occur if the following situation arises: the traction force on the concrete is greater than the weight of the foundation but less than the combination of suction and lateral friction forces.

In addition, a weight block must work in its middle third, if differential settling occurs, the block may tip over.

Or else by placing piles by driving or drilling.

With such foundations, any risk of differential settling is very small or completely absent, however such foundations are poor at withstanding lateral forces (cyclic or otherwise) and a real danger remains that they may be laid bare.

The present invention seeks to remedy the above-mentioned drawbacks of foundations as currently used industrially.

The object to be achieved is to provide foundations by creating a block which is constituted by the ground itself.

A loaded foundation causes the ground to settle.

If the in-service load from the structure on the surface gives rise to traction forces, the behavior of the foundation poses a strength problem given the poor or non-existant traction strength of the ground.

The object of the present invention is achieved by the method of making a foundation by creating a block constituted by the ground itself, in which method:

at least one deep anchor point is established by using anchor means buried underground by pile-driving, which means extend, when in the anchoring position, up to the surface of the ground in order to project beyond said surface;

a slab is placed on the surface, the slab including at least one opening for passing extensions from said anchor means; and traction is exerted on said slab in order to prestress the ground by using means situated above said slab to put said anchor means under tension until an in-service force is obtained suitable for holding the structure to be built on the surface.

In a preferred implementation of said method, a deep anchor point is obtained so as to obtain an underground effect of abutment against the ground by anchor means suitable for taking up a position which is substantially parallel to the surface of the ground on which said slab is disposed.

According to the method, the ground stress is directly evaluated and monitored by using a slab whose face in contact with the ground has an area equal to an integer multiple or submultiple of one square meter.

In order to implement the method, apparatus is used which is characterized by the fact that it comprises anchor means including at least one anchor line extending towards the surface of the ground and projecting beyond said surface, which anchor line is passed through an orifice made through a slab bearing against the ground, said anchor line being connected to means for putting it under tension, which means bear against said slab in order to put the ground under prestress under the effect of traction exerted on the slat towards the anchor point.

In such apparatus, the anchor means are constituted by an anchor comprising a rigid body including at least one ground-penetrating tip and an opposite end including an anvil against which a burying force is applied by pile-driving, said anchor further including a fin hinged about an axis extending transversely to said body and constrained to move through an angle limited to about 45°, and at least one anchor line connected to said body at at least one point situated between said ground penetrating tip and the center of gravity of the anchor body, said hinged fin being situated at the opposite end to the ground-penetrating tip and having its hinge axis offset from the midplane of the anchor body, which midplane includes the pile-driving axis, in which the anchor line is constituted by at least one tie connected to a fixing member pivoting about a transverse axis lying in said midplane of the anchor body, which tie is rigid and is constituted by a rod or a tube including connection means for enabling a plurality of ties to be put into alignment depending on the depth at which the anchor is buried in the ground, such that the last tie projects above ground level in order to enable the anchor line to be put under tension.

When the anchor is in position for burying in the ground, the ties in alignment which constitute the anchor line have their axis situated substantially in the midplane of the body of the anchor and passing substantially through the center of the anvil.

For driving the anchor into the ground, the anvil is driven via section bars of open or closed cross-section surrounding the anchor line and extending above the surface of the ground in order to be subjected to the action of pile-driving means.

Preferably, the slab includes, on its top face, a metal plate having an orifice situated over the orifice through the slab, with the diameter of the orifice through the plate being greater than the diameter of the orifice through the slab in order to make adjustment possible along two x and y axes.

In one embodiment, the means for putting the anchor line under tension comprise a frame bearing on said metal plate of the slab and including a conical housing whose wall generator lines converge towards the anchor means on a point situated on the axis of the ties constituting the anchor line with the last tie of the anchor line which passes through the slab extending into said conical housing and being threaded at its end in order to co-operate with a lock nut acting on wedges placed in the conical housing around the tie, said action taking place via a ring inserted between the wedges and the lock nut.

The periphery of the tie in contact with the locking wedges is fluted and includes microthreads in order to increase the grip of the wedges on the tie.

Said conical housing is formed in a moving part guided in a vertical direction relative to said frame, which moving part bears against resilient means surrounding the tie and inserted between said moving part and the bottom of the frame.

In another embodiment, the means for putting the anchor line under tension comprise a beam which is fixed to the last tie passing through the slab and the metal plate, which beam is situated above the slab and the plate and is subjected to the action of at least two jacks situated on either side of the tie and bearing against the metal plate which overlies the slab.

Said beam includes a central ring including a conical orifice whose wall generator lines converge towards the anchor point on a point situated on the axis of the tie, and the fixing of said tie to the beam is provided by locking wedges distributed around the tie and disposed in the annular space existing between the tie and the conical orifice.

The metal plate overlying the slab includes a projection including a conical orifice disposed coaxially with the orifice through the slab and whose wall generator lines converge towards the anchor point on a point situated on the axis of the tie and the anchor line is kept under tension by locking wedges distributed around the tie and disposed in the annular space existing between the tie and the conical orifice of said projection in such a manner as to cancel the pressure of the fluid in the hydraulic circuit leading to said jacks.

The periphery of each zone of the tie in contact with locking wedges is fluted or includes microthreads in order to increase the grip of the wedges on the tie.

By using prestress, it is possible to shift the in-service forces from structures made on the surface to compression forces and to keep them as compression forces so as to work only in the domain of stable compressions.

In a foundation constituted by a prestressed block of ground, a predetermined holding point is placed at a certain depth underground. This holding point constitutes an anchor point on which force is applied from the surface via a plate of steel covering a concrete slab, or via a plate of steel, or merely via a concrete slab.

After being put under stress, the mass of ground situated beneath the slab possesses mechanical characteristics which are different from those that existed before it was put under stress. The strength of the block as a foundation is determined by these new mechanical characteristics.

Beneath the slab bearing against the ground by stiffening on the anchor point, a network of isostress contours spreads through the ground and affects a portion of the surrounding terrain. The volume, and thus the weight, of the ground concerned by these isostress contours is thus much greater than that directly covered by the slab and is thus capable of constituting a foundation block.

With respect to foundation strength, the above-mentioned drawbacks inherent to using blocks of concrete, whether buried or not, or using piles or groups of piles driven into the ground disappear when using prestressed foundations because:

differential settling is avoided and the notion of force to be withstood in the middle third disappears, since the work takes place along the axis of the foundation; and there is no risk of the block being laid bare when subjected to lateral loads, when the size of the block concerned by the isostress contours is taken into consideration.

The above-mentioned advantages can be explained by the fact that the mechanical behavior of the ground can be controlled and adjusted by stiffening the ground to a greater or lesser extent on a deep anchor point in such a manner as to remain always below the creep limits of the ground, and resilient mechanical means installed on the surface will always be capable of taking up changes in the forces concerned.

In the method of making a block of prestressed ground, vertical downwards tension is exerted on a plate (or slab) placed on the ground. This tension is obtained by stiffening an anchor line having one of its ends fixed to a deep anchor point in order to take advantage of the underground effect of abutment against the ground, and at its other end, for example, by tightening a bolt on the last element of the tie which said anchor line constitutes, which bolt passes through the plate (or slab) placed on the surface.

The underground effect of abutment against the ground may be obtained, by example, either by an anchor in the form of a plate or else by means of the anchor device having a hinged element with a bent shape, and constituting the subject matter of French patent application number 84 07281.

The connection between the underground ground-abutment device and the surface plate is obtained by means of ties constituted by a cable, a rod, or a tube (or by trains of rods or tubes) which are dimensioned depending on the required forces. The force on the tie is taken up by means of a system of claw wedges or of other equivalent means for avoiding slipping.

In order to improve the anti-slipping performance of the locking device, microthreads may be provided, for example, on the last tie immerging from the ground slab, with the threads being provided in the zone of the tie which is in contact with the wedges.

In accordance with the invention, the surface plate is of such a size as to make it possible to evaluate and monitor the ground stress directly while the tie is being put under tension. For the purposes of such evaluation, the plate (or the plate and the concrete slab) is made in such a manner that its area is an integer multiple or submultiple of one square meter.

The underground anchor point is put into place by pile-driving.

The rod or the tube for taking up the stress force is fixed to the underground anchor.

The anchor line constituted by a cable, a rod, or a tube (or trains of rods and tubes), is put into place during the driving and simultaneously with the anchor by means of dummy driving piles constituted by tubes or section bars (e.g. channel section bars). Once the underground anchor has been positioned at the required depth, the dummy driving piles are withdrawn. The rod or the tube (or the train of rods or tubes) connecting the underground anchor to the plate (and/or the slab) on the surface is grasped by the above-described means by tightening the bolt or by other means including pneumatically or hydraulically operating actuators until the in-service force is obtained as required for the structure on the surface. Resilient means such as springs or spring washers, for example, may be incorporated at the surface at the top end of the uppermost tie in order to compensate or take up forces.

The method of the invention offers the advantage of being able to predetermine the strength of the block of ground put under stress and to improve its strength by stiffening the surface plate (and/or slab) on its underground anchor point to a greater or lesser extent. Throughout pile driving, and given the largest cross-section of the underground anchor system while it is being thrust into the ground, i.e. the outline of a section transverse to the axis along which the anchor line moves, it is possible, knowing the pile driving energy on each stroke, to determine the load-bearing capacity of the ground for each depth to which the anchor is buried. In addition, the plate (and/or the slab) on the surface and pulled down by stiffening the anchor line makes it possible to evaluate the stress of the ground at the surface by virtue of the extent to which it settles. These two possibilities taken together make it possible to determine the strength of any prestressed block of ground accurately.

The following description refers to the accompanying drawings which, by way of example, illustrate embodiments of apparatus in accordance with the invention for implementing prestressed blocks of ground.

Figure 2:
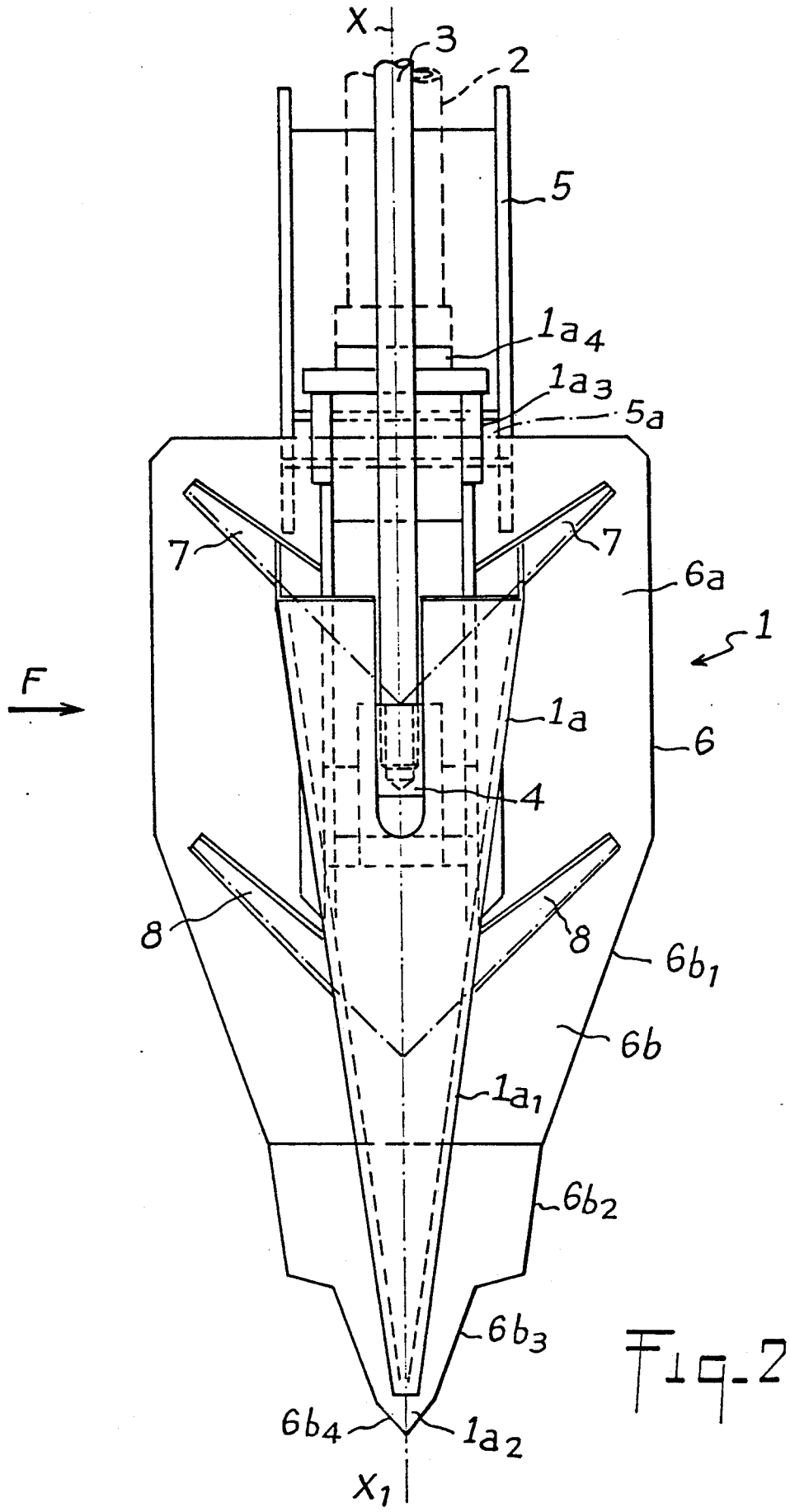
FIG. 2 is an elevation view of an anchor used in the apparatus of FIG. 1.
Figure 3:
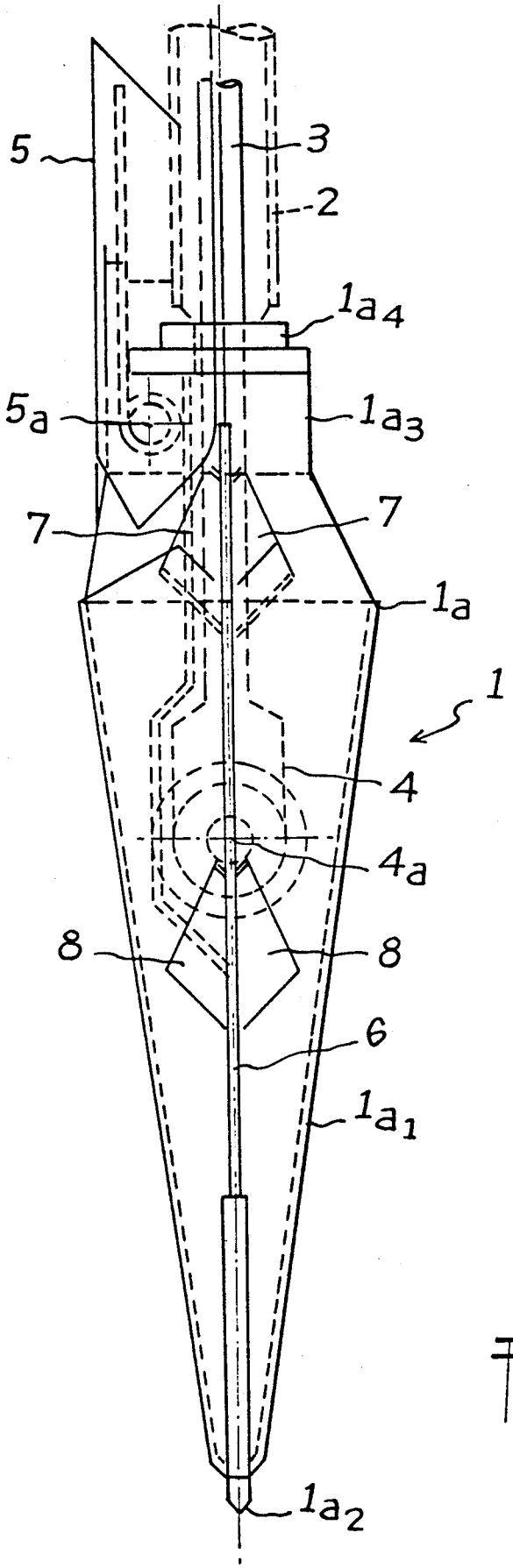
FIG. 3 is a view of the FIG. 2 anchor along arrow F.
Figure 5:
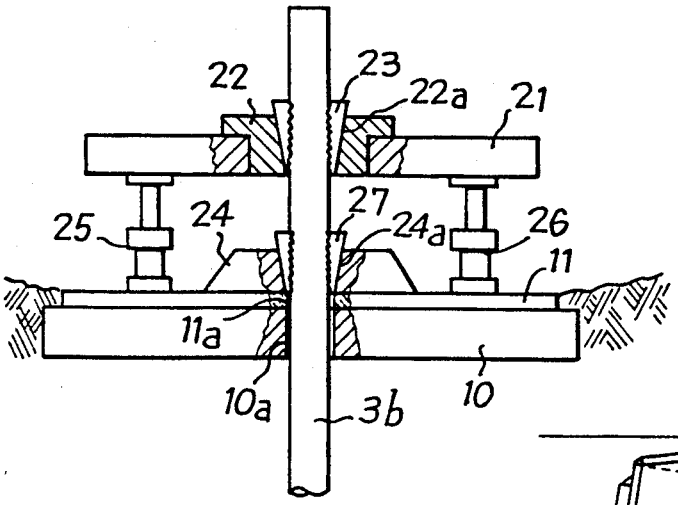

FIG. 5 is an elevation view in section through another example of means for putting the anchor line under tension. The anchor 1 (FIGS. 2 and 3) which is used in the apparatus of the invention is constituted, for example, by an anchor of the type described in French patent number 84 07281. It is specified that other, similar anchor means could be used for implementing the method of the invention.

Such an anchor 1 comprises a rigid body la having a conical or pyramid-shaped portion $1a_1$ whose bottom end terminates in a ground-penetrating tip $1a_2$. Its top end $1a_3$ has a circular or square right cross-section and includes an anvil $1a_4$ for being struck by burying forces obtained by pile-driving via tubular elements or channel section bars 2 which surround an anchor line 3 fixed to a pivoting part 4 which pivots about an axis extending transversely to the anchor 1.

The pivot axis 4a of the part 4 is situated between its tip $1a_2$ and the center of gravity of the anchor, and it lies in the plane of symmetry of the body 1a.

At its end opposite to its ground-penetrating tip $1a_2$, the anchor 1 includes a hinged element 5 constituting a kind of fin, which fin is pivotally mounted on the body 1a about an axis 5a extending transversely to the anchor and offset away from the plane of symmetry of the body 1a which also includes the pivot axis 4a for the part 4. The hinged element 5 is designed to be capable of moving through a limited angle of about 45°.

In the plane containing said pivot axis for the part 4, the anchor 1 includes a plate 6 which projects symmetrically beyond the body 1a (FIG. 2) and includes a rectangular portion 6a which extends approximatelY from the hinge axis 5a of the hinged element 5 to the pivot axis 4a of the part 4 with the cross-section of the anchor at this location constituting the largest cross-section of the anchor. The plate 6 extends towards the ground-penetrating tip $1a_2$ in the form of a symmetrically tapering portion 6b for facilitating penetration of the anchor into the ground, said portion 6b being delimited by a sequence of edges $6b_1/6b_2/6b_3/6b_4$ which converge at different angles towards the axis of symmetry $XX_1$ of the anchor.

The plate 6 is stiffened by gusset plates 7 and 8 fixed on either side of the plate 6 and forming deflectors which converge towards the axis of symmetry of the anchor $XX_1$ in order to facilitate penetration of the anchor into the ground.

While the anchor 1 is in its position for being driven into the ground, the anchor line 3 is situated on the axis $XX_1$ of the anchor 1.

In this position, the anchor line and the intermediate pile-driving elements 2 or dummy piles are substantially coaxial when constituted by tubes.

Figure 1:
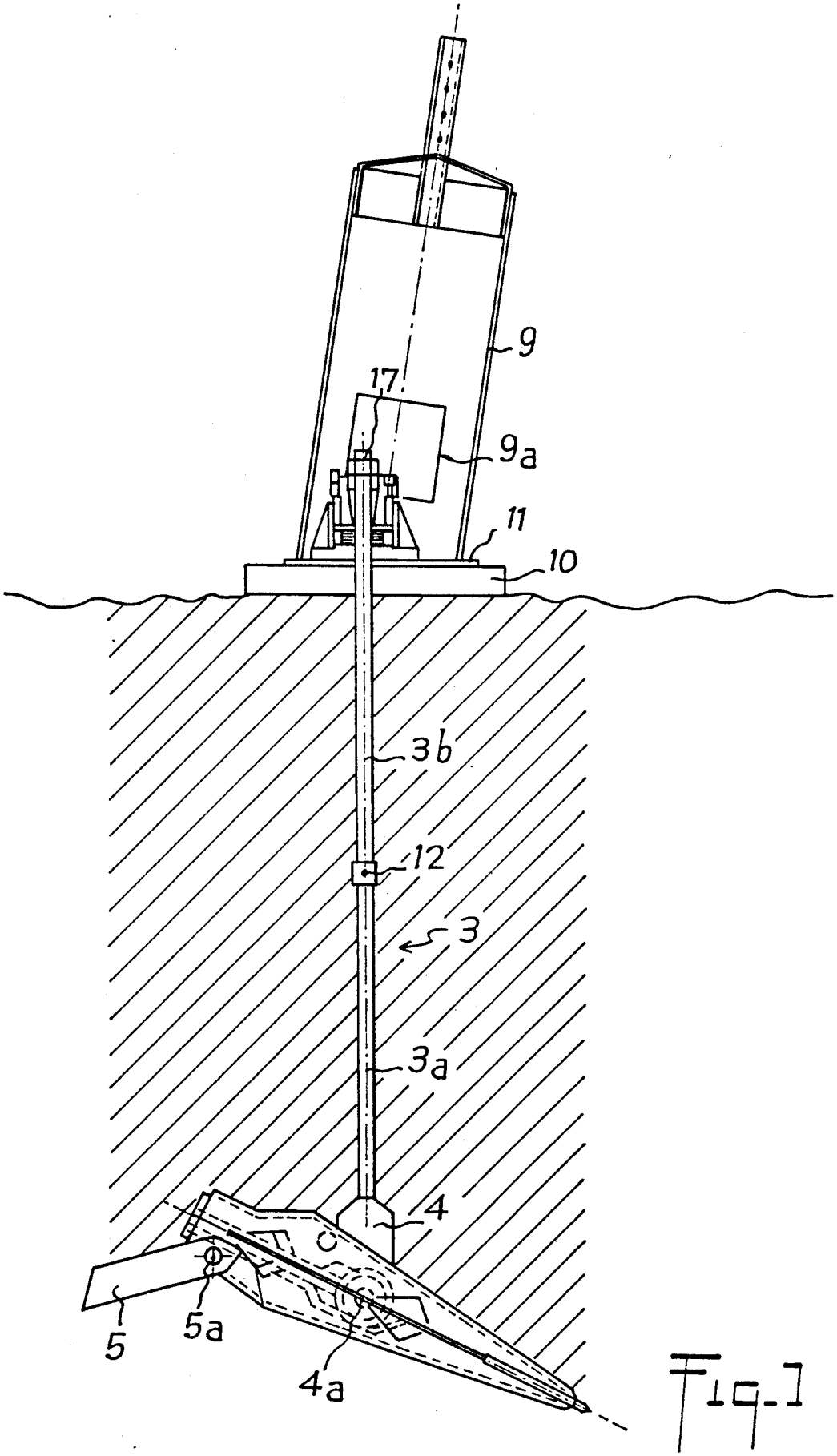
FIG. 1 is a diagrammatic section through anchor apparatus for a leg of an electricity pylon.

Reference is now made to FIG. 1 of the drawings which shows the leg 9 of a pylon being anchored, said leg standing on the ground via a slab of reinforced concrete 10 which is covered, for example, by a steel plate 11, with the slab and plate assembly 10/11 having the anchor line 3 passing therethrough.

The anchor line is constituted by ties, e.g. in the form of tubes 3a/3b which are interconnected by a connecting sleeve 12.

Figure 4:
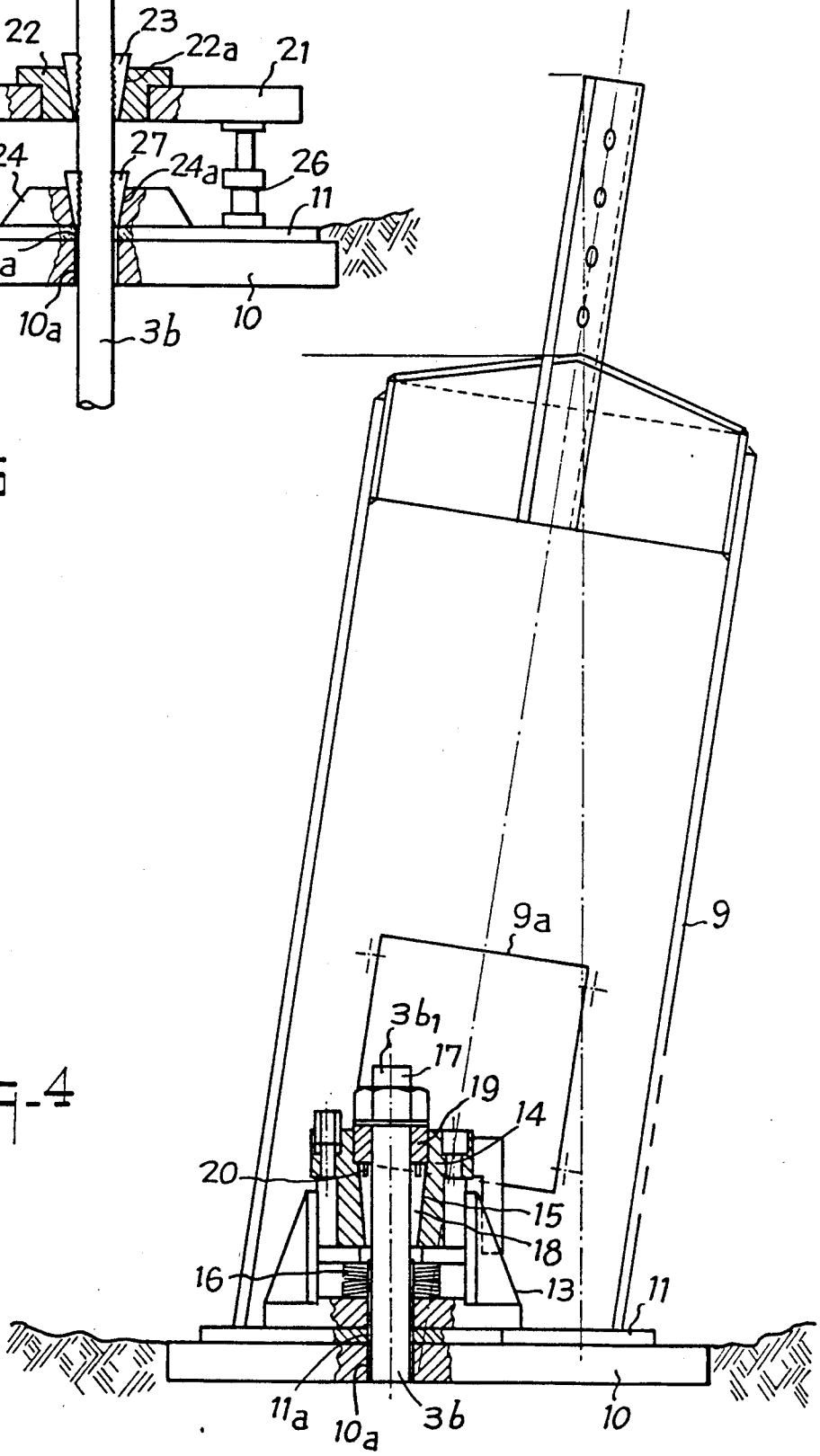
FIG. 4 is an elevation view on a larger scale showing the FIG. 1 pylon leg and one example of means for putting the anchor line under tension.

FIG. 4 shows the pylon leg 9 on a larger scale together with the means for putting the anchor line under tension in order to prestress the ground.

The slab 10 has an orifice 10a situated facing a larger diameter orifice 11a through the plate 11 which covers the top face of the slab, which plate is itself fixed to the pylon leg 9. The difference in diameter between the orifices 10a and 11a makes it possible to perform X/Y adjustment of the position of the plate 11 relative to the slab 10. The pylon leg takes up a sloping position and is constituted bY a tubular element including a manhole 9a for gaining access to its inside.

The top end of the tube 3b is passed through the orifices 10a and 11a and projects into the pylon leg 9 through apparatus for putting the anchor line under tension. This apparatus comprises a frame 13 bearing against the metal plate 11 and including a moving part 14 which itself includes a conical housing 15 through which the tube 3 is passed. The generator lines of the wall of said housing converge towards the anchor 1 on a point situated on the axis of the anchor line 3. The moving part 14 bears against resilient means 15, e.g. spring washers, inserted between the moving part 14 and the bottom of the frame 13.

The top end $3b_1$ of the tube 3b is threaded and it cooperates with a nut 17. Locking wedges 18 are disposed around the tube 3b inside the conical housing 15, there may be three wedges, for example, disposed at 120° intervals. A ring 19 disposed between the nut 17 and the wedges 18 is connected thereto by means of pins 20 or other similar members.

The anchor line 3 is put under tension and the ground is correspondingly prestressed by tightening the nut 17. When the anchor line 3 is put under tension, the anchor pivots about the axis 4a and the fin 5 pivots about the axis 5a, until the anchor is locked in position in the ground substantially parallel to the surface of the ground as shown in the drawing of FIG. 1.

The periphery of the zone of the tie constituted by the tube 3b which is in contact with the locking wedges is fluted and includes microthreads for increasing the grip of the wedges on the tie.

The ground is prestressed by tightening the nut 17 to a greater or lesser extent as described above.

Another embodiment of the means for putting the anchor line 3 under tension is shown in FIG. 5 of the drawing.

These means are constituted by a beam 21 having a central ring 22 including a conical orifice 22a whose wall generator lines converge towards the anchor point on a point situated on the axis of the tie 3b. The tie 3b is fixed to the beam 21 by locking wedges 23, which may be three in number and disposed at 120° intervals, for example, and which are disposed around the tie in the annular space between the tie 3b and the conical orifice 22a.

In this embodiment, the metal plate 11 covering the slab 10 includes a projection 24 including a conical orifice 24a which is coaxial with the orifice 10a of the slab and whose wall generator lines converge towards the anchor point on a point situated on the axis of the tube 3b.

The anchor line is put under tension, for example, by means of two jacks 25 and 26, e.g. single action hydraulic jacks. The tension on the anchor line 3 is maintained, for example, by means of three locking wedges 27 distributed at 120° intervals around the tube 3b and disposed in the annular space between the tube and the conical orifice 24a.

After the locking wedges have been pushed home and secured to the tube 3b, the pressure in the hydraulic circuit is reduced until there remains no operating pressure.

Like the apparatus described with reference to FIG. 4, the periphery of the zones of the tubes 3b coming into contact with the locking wedges 23 and 27 is fluted and includes microthreads in order to increase the grip of the wedges on the tube. Also, the portions of the wedges 18, 23, or 27 coming into contact with the tubes can be toothed in order to further increase the strength of their engagement in the periphery of the tube.

The method and apparatus of the invention may be used, inter alia, for stiffening clays and marls which are saturated or supersaturated with water, or for obtaining stable foundations in sand deserts.

It may be observed that the stiff components of the anchor line 3 (ties, tubes, etc.) could be replaced by suitable cables.

We claim:

1. A method of making a foundation by creating a block constituted by prestressed ground, for holding a structure means to be built on the surface of the ground, said method comprising establishing at least one deep anchor point by using anchor means buried underground by pile-driving, said anchor means comprising extensions, extending up to the surface of the ground, in order to project beyond said surface, placing a slab on the surface of the ground, said slab including at least one opening for passing the said extensions, which extend from said anchor means, said extensions being connected to traction means, and said anchor means being able to pivot around a transversal axis and substantially parallel to the surface of the ground, the method further comprising the following steps:

exerting an action to said traction means, from the surface of the ground, first to the said anchor means, so that an underground effect of abutment against the ground can be obtained by suitable means of said anchor means for taking up a position, which is substantially parallel to the surface of the ground, on which said slab is disposed, and, pursuing the traction to be exerted on the said slab, in order to prestress the ground between said anchor means and said slab, by using the said traction means situated above said slab to put the said anchor means under tension, until an in-service force is obtained, suitable for holding the said structure means.

2. A method according to claim 1, further comprising the step of directly evaluating and monitoring the ground stress by actioning the said traction means disposed on the said slab, the face of which, in contact with the ground, has an area equal to an integer multiple or submultiple of one square meter.

3. Apparatus comprising anchor means including at least one anchor line extending towards the surface of the ground and projecting beyond said surface, a slab bearing against the ground and having an orifice therethrough, said anchor line being passed through said orifice, said anchor line being connected to means for putting it under tension, which means bear against said slab, in order to put the ground under prestress, under the effect of traction exerted on the slab towards an anchor point.

4. Apparatus according to claim 3, wherein the anchor means is constituted by an anchor comprising a rigid body, including at least one ground-penetrating tip, and an opposite end including an anvil, against which a burying force is applied by pile-driving, said anchor further including a fin hinged about an axis extending transversely to said body and constrained to move through an angle limited to about 45°, at least one anchor line connected to said body at at least one point situated between said ground-penetrating tip and the center of gravity of the anchor body, said hinged fin being situated at an opposite end to the ground-penetrating tip and having its hinge axis offset from a midplane of the anchor body, which midplane includes a pile-driving axis, and wherein the anchor line is constituted by at least one tie connected to a fixing member pivoting about a transverse axis lying in said midplane of the anchor body, which tie is rigid and is constituted by a rod or a tube including connection means for enabling a plurality of ties to be put into alignment depending on the depth at which the anchor is buried in the ground, such that the last tie projects above ground level in order to enable the anchor line to be put under tension.

5. Apparatus according to claim 4, wherein, when the anchor is in position for burying in the ground, the ties in alignment which constitute the anchor line have their axis situated substantially in the midplane of the body of the anchor and passing substantially through the center of the anvil.

6. Apparatus according to claim 5, wherein section bars are provided for driving the anvil, said section bars being of open or closed cross-section surrounding the anchor line and extending above the surface of the ground, in order to be subjected to the action of pile-driving means.

7. Apparatus according to claim 6, wherein the slab includes, on its top face, a metal plate having an orifice situated over the orifice through the slab, with the diameter of the orifice through the plate being greater than the diameter of the orifice through the slab in order to make adjustment possible along two x and y axes.

8. Apparatus according to claim 7, wherein the means for putting the anchor line under tension comprise a frame bearing on said metal plate of the slab and including a conical housing whose wall generator lines converge towards the anchor means on a point situated on the axis of the ties constituting the anchor line with the last tie of the anchor line which passes through the slab extending into said conical housing and being threaded at its and in order to cooperate with a lock nut acting on wedges placed in the conical housing around the tie, said action taking place via a ring inserted between the wedges and lock nut.

9. Apparatus according to claim 8, wherein the periphery of the tie in contact with the locking wedges is fluted and includes microthreads in order to increase the grip of the wedges on the tie.

10. Apparatus according to claim 9, wherein the conical housing is formed in a moving part guided in a vertical direction relative to said frame, which moving part bears against resilient means surrounding the tie and inserted between said moving part and the bottom of the frame.

11. Apparatus according to claim 10, wherein the means for putting the anchor line under tension comprises a beam which is fixed to the last tie passing through the slab and the metal plate, which beam is situated above the slab and the plate and is subjected to the action of at least two jacks situated on either side of the tie and bearing against the metal plate which overlies the slab.

12. Apparatus according to claim 11, wherein said beam includes a central ring including a conical orifice whose wall generator lines converge towards the anchor point on a point situated on the axis of the tie, and fixing of said tie to the beam is provided by locking wedges distributed around the tie and disposed in the annular space existing between the tie and the conical orifice.

13. Apparatus according to claim 12, wherein the metal plate overlying the slab includes a projection including a conical orifice disposed coaxially with the orifice through the slab and whose wall generator lines converge towards the anchor point on a point situated on the axis of the tie, and wherein the anchor line is kept under tension by locking wedges distributed around the tie and disposed in the annular space existing between the tie and the conical orifice of said projection in such a manner as to cancel the pressure of the fluid in the hydraulic circuit leading to said jacks.

14. Apparatus according to claim 13, wherein the periphery of each zone of the tie in contact with locking wedges is fluted or includes microthreads in order to increase the grip of the wedges on the tie.

* * * * *